United States Patent [19]

Wrassman

[11] Patent Number: 4,501,047

[45] Date of Patent: Feb. 26, 1985

[54] METHOD AND APPARATUS FOR SEPARATING FIBERS

[76] Inventor: William H. Wrassman, 5710 Shadyhollow Ln., Cincinnati, Ohio 45230

[21] Appl. No.: 457,769

[22] Filed: Jan. 13, 1983

[51] Int. Cl.[3] ..... D01G 9/04; D01G 13/00

[52] U.S. Cl. ..... 19/85; 19/145.5; 241/98; 241/292.1

[58] Field of Search ..... 19/1, 65 R, 65 A, 204, 19/205, 80 R, 80 A, 85, 145.5, 214; 241/96, 55, 241/60, 73, 282, 291, 292.1

[56] References Cited

U.S. PATENT DOCUMENTS

| | | | |
|---|---|---|---|
| 708,133 | 9/1902 | Franke | 19/85 |
| 1,358,034 | 11/1920 | Snyder | 19/85 |
| 1,408,850 | 3/1922 | Webb | 241/291 |
| 1,758,445 | 5/1930 | Kay | 241/282 |
| 1,916,192 | 5/1930 | Davis | 241/292.1 |
| 2,223,543 | 12/1940 | Berkman | 19/1 |
| 2,375,187 | 5/1945 | Berkman et al. | 19/1 |
| 2,386,401 | 10/1945 | Joyce | 19/1 |
| 2,809,400 | 10/1957 | Maltenfort | 19/4 |
| 3,061,889 | 11/1962 | Vincent | 19/1 X |
| 3,554,454 | 1/1971 | Gruendler | 241/73 |
| 3,807,646 | 4/1974 | Leiter et al. | 241/60 |
| 3,974,969 | 8/1976 | Herbst | 241/98 |
| 4,049,204 | 9/1977 | McKee | 241/55 |

*Primary Examiner*—Louis K. Rimrodt

*Attorney, Agent, or Firm*—Wood, Herron & Evans

[57] ABSTRACT

Disclosed is an apparatus and method for separating clumps of resilient fibers such as aramid polymer fiber agglomerates. Rotating blades throw the fiber clumps outwardly against a surrounding resilient "cushion" of fibers of the material. Rather than physically cutting or chopping the fibers, the blade tips exert a rubbing or dissecting action on the clumps. The separated fibers are swept to an outlet by an airstream, while unseparated fibers in the cushion are urged toward the blades for further separation. It is an important advantage of the invention that the average length of the fibers is not substantially reduced as the clumps are being separated by the blades.

15 Claims, 2 Drawing Figures

METHOD AND APPARATUS FOR SEPARATING FIBERS

FIELD OF THE INVENTION

This invention relates to the separation of fibers from larger fibrous agglomerates.

BACKGROUND OF THE INVENTION

Aramid fibers, including fibers of the "Kevlar" aramid polymer manufactured and sold by DuPont, are finding wide usage as a reinforcing material in gaskets, moldings, bulletproof vests, and other applications wherein they provide qualities of excellent tensile strength, light weight, and/or heat resistance. Although these fibers can be manufactured in continuous filament fiber form, for example by extrusion through spinerettes, for some purposes it is more convenient and less expensive for the supplier to ship such materials in the form of multiple fiber agglomerates or clumps, rather than as discrete fibers. The fiber agglomerates may for example be in the form known as "pulp," wherein many short fibers are closely matted as a spongy mass, somewhat like a cotton ball. In another common form, the product may be in the form of "fiber staple," which comprises clumps of longer, roughly parallel fibers. Other common examples of resilient fibrous materials sometimes supplied in fibrous agglomerate form include carbon fibers, Mylar fibers, nylon fibers, asbestos, and so on.

Where the user receives a fibrous material in the form of pulp, staple, or other multi-fiber agglomerate, it is often necessary that the material be separated into discrete fibers. The process of fiber separation is sometimes referred to as fiber "development," "expansion," or "exfoliation". This is required where individual fibers are to be coated or mixed with various bonding agents, for example, as where fibers are to be mixed with a matrix material for molding, or where the fibers are to be incorporated in friction linings or gaskets. It is to such fiber separation that this invention is directed.

PRIOR ART

Apparatus for separating asbestos into discrete fibers is known in the art. Such apparatus is shown in Herbst Pat. No. 3,974,969, issued Aug. 17, 1976, which teaches separation by rotary blades mounted on a shaft which projects through the sidewall of a mixing drum, radially toward the drum axis. The blades have step-like radial edges and rotate in planes parallel to the axis of the chamber; the fibers are swept across the blades by separate rotating arms. Such apparatus is expensive, bulky and relatively slow acting. Moreover, it is often desirable to obtain the highest possible fiber volume per unit weight, in order to maximize fiber surface area and strengthening effect when mixed with binder; but the prior art apparatus has not provided a high a degree of fiber fluffing or expansion. Thus there has been a clear need for a faster acting, less expensive apparatus and process, suitable for the small user as well as by the large manufacturer, for developing asbestos, Kevlar and other fiber agglomerates to high volume/weight form.

BRIEF DESCRIPTION OF INVENTION

I have discovered that fibrous agglomerates can be separated into discrete fibers by a technique wherein the clumps are confined and are resiliently contacted with a series of blades which have pick-like or pointed tips. The agglomerates are held resiliently in contact with the blades; the blades do not shear or grind the fibers against a fixed rigid surface. A surrounding mass of fibers resiliently urges fibers radially toward the blades. An airstream removes the separated fibers, but not the agglomerates, from the confined space.

In a preferred form of apparatus in accordance with the invention the blades are spaced along a shaft which is rotated to provide a blade tip velocity preferably of at least about 5000 feet per minute, and more preferably at least 7000. The shaft is journaled in a cylindrical chamber which provides a spacing between the blade tips and the cylinder inside wall substantially larger than the diameter of the fibers and greater than the fiber length. The resilient fibers are thrown outwardly by the rapidly rotating blades, but the housing resiliently confines the fibers so that they remain near the tips, where they are lightly engaged by the blade tips. The action of the blades on the fibers appears to be a tangential rubbing and dissecting action; the blades exfoliate or rub the clusters into smaller clusters, and ultimately dissect individual fibers from the clusters. The minimum spacing between the blade tips and the wall is much greater than the diameter of the fibers and the blades do not crush or trap the fibers against the chamber wall.

Without intending to limit the invention, it is theorized that this rubbing/dissecting action is enhanced because the resiliency of fibers between the blades and the chamber wall tends to "bias" inner fibers toward the blades so that they can yield resiliently outwardly when the blades impact them. It is to be noted that this apparatus does not cut the fibers, i.e., does not substantially reduce average fiber length, but rather separates fibers from the fiber bundles without substantial length reduction.

It is important that fibers be conveyed past the blades and to and out of an outlet by an airstream, the rate of flow of which is sufficient to carry separated fibers to the outlet but insufficient to remove the fiber agglomerates. It is further desirable that the space between the blades and the chamber wall be in the form of a cylindrical annulus with the shaft at its center. The air stream carries the fibers in a spiral path through this annular space.

The invention can best be described and explained by reference to the accompanying drawing, in which:

FIG. 1 is an axial section, somewhat diagrammatic in nature, of apparatus in accordance with a preferred embodiment of the invention; and FIG. 2 is an enlarged perspective view of a preferred form of a single blade having four pick-like points, for use in the apparatus of FIG. 1.

DETAILED DESCRIPTION

Figure 1:
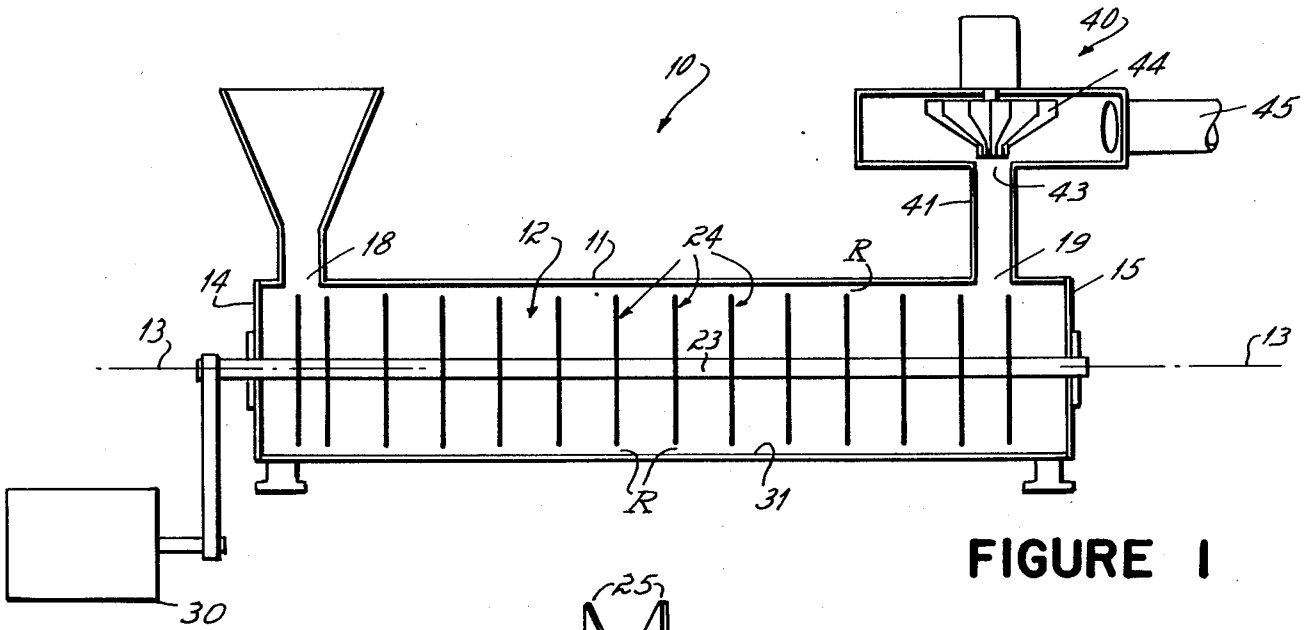
Figure 2:
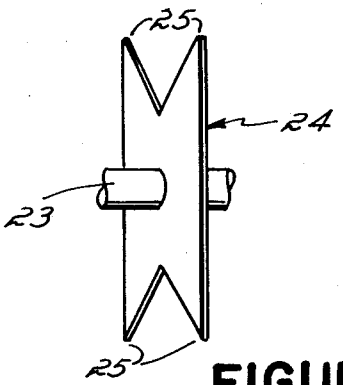

Referring to FIG. 1, an apparatus 10 is illustrated having a hollow generally cylindrical housing 11 which presents a processing chamber 12 on its interior. Housing 11 is preferably oriented to that its axis 13 is horizontal. The housing may be a length of steel or plastic pipe, closed at its ends by end plates 14, 15. An inlet 18 enters chamber 12 through the sidewall, adjacent one end plate 14, and an outlet 19 is provided through the side wall adjacent the other end 15. It is preferred, although not absolutely necessary, that inlet 18 direct incoming material downwardly radially toward the axis 13 of chamber 12. It is also preferred, but not absolutely necessary, that the outlet 19 be spaced in the axial direction from inlet 18, and that it projects upwardly from chamber 12 as shown in FIG. 1.

A shaft 23 is journaled in the end plates 14, 15 of housing 11 and extends through chamber 12 along axis 13. This shaft mounts a series of blades 24 (in the embodiment shown there are 15 such blades, although number is not critical). The blades are spaced along the length of the shaft. Each blade 24 has one or more pick-like tips, as at 25. In the embodiment shown the blades 24 are of what may be described as a "butterfly" shape with four tip points 25; the four tips define a rectangle with a deep V notch between the two tips on the same side of shaft 23. The blades can suitably be punched or cut from ⅛" steel; the pointed tips 25 are formed where the sides of the "V" meet the long sides of the blade. Each tip 25 can thus be formed by the intersection of two essentially planar surfaces; the tips need not form a conical point. Other blade shapes can be used, but the blades should have tips which are defined by an acute angle. The edges of the blade inward of the tip need not be sharpened, since it is not desired to cut the material. On the contrary, it is desired not to cut the fibers. Shaft 23 is rotated by a high speed drive motor 30, preferably capable of developing a blade tip speed of 5000 feet per minute or more.

The radial distance between the tips 25 of the blades and the inside surface 31 of housing 11, which distance is designated at R in FIG. 1, should generally be greater than the diameter of any solid particles which are fed into the machine, and should be many times greater than the diameter of the single fibers separated from the bundles. This insures that the individual fibers are not caught and sheared between the blades and the wall. By way of example, a blade tip clearance of about ¼" works well for use of Kevlar pulp. This is many times larger than the fiber diameter, which is of the order of 10–30 microns.

The device requires a high tip speed for most efficient exfoliation. I have found that blade tip speeds in excess of about 5000 ft. per minute, and preferably of 7000 to 9000 feet per minute, are very effective for exfoliating Kevlar pulp and staple. At low speeds the incoming agglomerates increasingly tend to become "impaled" on the tips, which in turn tends to clog or jam the machine. The rotor speed should be such that the agglomerates and fibers are slung outwardly by centrifugal force as they are swept through the annular space 33 outwardly of the blade tips 25 and inwardly of the cylinder wall 31. Virtually none of the particles pass through the series of blades inwardly of the tips.

The separated fibers are carried from the inlet to the outlet by an air current. This current is preferably of such velocity as to carry the separated fibers out of the outlet, but not to remove the feed or unexpanded fiber agglomerates. This air current can be established by a blower or source of compressed air which creates a positive pressure at the inlet, and/or by a blower which creates a reduced pressure at the outlet. In the embodiment shown, a high-speed centrifugal blower 40 (e.g., 10,000 rpm) is mounted in outlet line 41. Line 41 feeds the blower inlet 43; the blower has a rotary impeller 44 which receives fibers centrally and slings them outwardly to deliver the fibers to a discharge line 45. This blower preferably establishes a pressure differential between inlet and outlet of about 50" water. More generally, the differential should be at least about 40" for processing Kevlar pulp.

It is found that the provision of a centrifugal blower having an inlet which is fed through the processing chamber outlet line 41 does more than merely provide an inlet-to-outlet draft to carry the fibers past the blades. The blower impeller itself acts on the fibers in a way that further "de-clumps" or expands them, and increases fiber volume above what it was prior to entering the blower. This can be observed from the fact that the volume of a given weight of feed material is increased when the draft is established by a centrifugal impeller at the outlet so that the fibers pass through it, as compared to fiber volume if the draft is established by the same blower positioned at the inlet, upstream of the point where the particles are introduced, so that the fibers do not pass the impeller.

It is important that incoming fiber particles not be fed into the machine at such rate as to choke it. For that reason it is usually desirable to feed the material gradually, as by using a gate or shutter valve through which material can be introduced intermittently or at a restricted rate. These valves are known in the art and do not comprise the invention.

Although it is preferred that the processing chamber present a cylindrical space as illustrated, and that the particles be introduced in the radial direction into the plane of rotation of the one or more blades, it should be understood that the feed material can alternatively be introduced in the axial direction, and that the chamber need not be cylindrical. In general, the use of a cylindrical chamber having a smooth internal surface and oriented horizontally, wherein the particles are conveyed entirely by the action of air rather than by gravity or by impeller type blades, provides much better results. This can be seen by the following example.

SPECIFIC EXAMPLE

As previously indicated, this machine can be quite small and yet have extremely high throughput as compared to devices of the type shown in the Herbst patent previously identified. A test was made using a machine in accordance with that shown in FIG. 1 of the drawing, wherein the cylinder was 30" long, had an inside diameter of 6", the diameter of the blades (as measured diametrically from tip to tip) was 5.5", and the blades rotated at a speed of about 7000 rpm or 10,000 feet per minute. Blade tip clearance was 0.25", which was greater than average fiber length of 0.2". This machine would handle a throughput of 10 pounds per minute of Kevlar pulp, and expanded it to fibers having approximately 40 times the volume of the input material. A centrifugal blower, rotating at 10,000 rpm, was connected to the outlet. The blower established an airstream through the chamber from the inlet and through the outlet at a pressure differential of about 50" water. The agglomerates were poured into the airstream at the inlet.

The machine described did not work when the blower was not operating, that is, when there was no airstream through the chamber. This is so even if the chamber is set vertically, so that gravity draws fibers toward the outlet. If the blower was mounted at the inlet, rather than the outlet, so as to blow air through the chamber but without the separated fibers passing through the impeller, the fiber agglomerates were separated, but the volume expansion was only 20×, rather than the 40× expansion obtained when the fibers passed through the blower at the outlet. The device worked best if oriented horizontally, but worked acceptably (at a slower rate) if oriented vertically. At lower blower speeds, below approximately 5000 rpm, there is rapid loss of fluffing capacity, and chunks of unfluffed material appear at the outlet.

The same machine was also used to separate clusters of asbestos, nylon and carbon fibers. Generally comparable volumetric expansion (approximately 30–40×) was achieved in each case.

A molding resin for example phenolic resin, or a molding filler such as dolomite, carbon black, barium carbonate, or cashew particles, in particle form, could be introduced directly into the apparatus along with the fiber agglomerates. The blades intimately mixed the additive with the fibers, and/or coated it on the fibers. The fiber/additive mix was conveyed to and through the outlet by the airstream. The composite mixture could be molded to a uniform product in the usual manner without further mixing.

From the foregoing it will be seen that I have provided a compact, efficient, means for exfoliating aramid and other flexible fibrous agglomerates at a high rate, which provides much better results than prior art devices.

Having described the invention, what is claimed is:

1. A process for dissecting the fibers of fibrous agglomerates comprising, introducing the fibrous agglomerates into a processing chamber, contacting the agglomerates in the chamber with a series of rotating blades having picklike pointed tips, the blade tips being sufficiently spaced from walls which define the chamber to permit agglomerates to accumulate between the paths of the blade tips and the wall, rotating the blades at a tip speed of at least about 5,000 feet per minute, the rotation of the blades tending to throw the agglomerates radially outwardly toward the walls, confining a portion of the agglomerates and dissected fibers in the chamber between the chamber walls and the blades by restricting egress from the chamber sufficiently that the confined fibers resiliently bias the agglomerates radially inwardly into contact with the pointed tips of the blades so that the tips dissect fibers in the agglomerates, the dissected fibers being restricted by the walls from movement further outwardly from the blades, and passing an airstream through the chamber which is of sufficient velocity to remove dissected fibers but not agglomerates from the chamber.

2. The process of claim 1 wherein the fibers are confined within an annular space between tips of the rotating blades and a chamber wall.

3. The process of claim 2 wherein the dissected fibers are confined within an annular space having a radial width which is substantially greater than the diameter of the fibers, and also greater than the length of the fibers.

4. The process of claim 3 wherein the agglomerates are introduced into a cylindrical chamber and the separated fibers are carried longitudinally through the chamber by the air stream.

5. The process of claim 4 wherein the agglomerates are introduced into said chamber adjacent one end thereof and are moved in a spiraling path through the annular space by said air stream, toward another end thereof.

6. The process of claim 1 wherein the dissected fibers are removed from the chamber and are passed into and through an impeller type blower, to an outlet.

7. The process of claim 1 wherein a particulate matrix material is also introduced into said chamber as said fibers are being separated and is coated onto the fibers by said blades.

8. A process of dissecting the fibers of fibrous agglomerates of synthetic polymers comprising, introducing the fibrous agglomerates into an elongated cylindrical processing chamber having a smooth uninterrupted inside wall, wherein the agglomerates are contacted by a series of radially projecting blades mounted to a shaft rotating on the axis of the housing, the blades having picklike pointed tips and rotating at a tip speed of at least 5000 feet per minute, rotating the shaft at such velocity that the blades throw the agglomerates radially outwardly toward the wall of the chamber and dissect fibers from them by engagement with the blade tips, retaining sufficient dissected fibers in an annular space between the blades and the chamber wall that they exert a resilient biasing action on the agglomerates which urges them toward the shaft and into contact with the blades, and establishing an airstream along the length of the chamber which is sufficient to carry dissected fibers to an outlet but insufficient to carry agglomerates to the outlet.

9. The process of claim 8 wherein the chamber and shaft are oriented horizontally, and wherein gravity does not convey agglomerates longitudinally through the chamber.

10. The process of claim 9 wherein the agglomerates are introduced into said chamber by feeding them downwardly through a vertical inlet adjacent one end of the chamber, and the fibers are removed from the chamber by the airstream which carries them upwardly through an outlet extending vertically upwardly from a second end of said chamber.

11. The process of claim 10 wherein the dissected fibers are passed through the a centrifugal blower having an impeller with an intake connected to said outlet whereby the fibers are further separated.

12. Apparatus for separating fibers of fibrous agglomerates such as asbestos, aramid polymers, carbon fibers, Mylar fibers, and nylon fibers, comprising, a housing presenting a cylindrical processing chamber, a shaft rotatable in said chamber, the shaft having a series of radial blades mounted to it along its length, the blades presenting picklike pointed tips, the chamber presenting a narrow annular space outwardly of the tips, means for rotating the shaft to provide a blade tip speed of at least 5000 feet per minute, an inlet adjacent one end of said chamber, an outlet adjacent a second end of said chamber, and means providing an airstream from said inlet to said outlet through the chamber, the air stream being of sufficient velocity to carry fibers but not agglomerates to said outlet.

13. The apparatus of claim 12 wherein said chamber is cylindrical and said shaft rotates on the axis of said chamber.

14. The apparatus of claim 12 wherein said shaft is rotated at a rate such that the blades throw the agglomerates outwardly in the chamber, the housing retaining fibers in said annular space in proximity to the blades so that the retained fibers urge agglomerates inwardly toward the path of rotation of the blade tips.

15. The apparatus of claim 12 further including an inlet oriented radially toward a blade.

* * * * *